US005415098A

United States Patent [19]

Ward

[11] Patent Number: 5,415,098

[45] Date of Patent: May 16, 1995

[54] METHOD AND APPARATUS FOR HANDLING SHEET MATERIAL USING RIDGED NETTING

[76] Inventor: Donald A. Ward, 21831 NW. 6th St., Pembroke Pines, Fla. 33029

[21] Appl. No.: 181,777

[22] Filed: Jan. 18, 1994

[51] Int. Cl.[6] ..... B41F 21/00

[52] U.S. Cl. ..... 101/493; 101/420

[58] Field of Search ..... 101/416.1, 417, 418, 101/419, 493, 420, 422, 415.1, 409, 410; 106/2

[56] References Cited

U.S. PATENT DOCUMENTS

| | | | |
|---|---|---|---|
| 401,790 | 4/1889 | Osborne . | |
| 944,607 | 12/1909 | Goldsmith . | |
| 1,152,596 | 9/1915 | Boucher . | |
| 1,231,141 | 6/1917 | Ellis . | |
| 1,231,142 | 6/1917 | Ellis . | |
| 1,255,603 | 2/1918 | Hartmann . | |
| 1,414,104 | 4/1922 | Strawn . | |
| 1,711,596 | 5/1929 | Grammer | 101/422 |
| 1,933,161 | 10/1933 | Claybourn et al. | 101/422 |
| 2,878,742 | 3/1959 | Trump | 95/94 |
| 3,261,288 | 7/1966 | Dickerson | 101/420 |
| 3,308,522 | 3/1967 | Miller | 101/420 |
| 3,750,571 | 8/1973 | Germann | 101/415.1 |
| 3,791,644 | 2/1974 | DeMoore | 271/80 |
| 3,892,179 | 7/1975 | Jahn | 101/415.1 |
| 3,910,186 | 10/1975 | D'Amato et al. | 101/156 |
| 4,023,967 | 5/1977 | McGibbon | 96/1 LY |
| 4,214,526 | 7/1980 | Jeschke | 101/183 |
| 4,227,459 | 10/1980 | Jeschke | 101/415.1 |
| 4,402,267 | 9/1983 | DeMoore . | |
| 4,691,632 | 9/1987 | DeMoore | 101/422 |
| 4,973,040 | 11/1990 | Kemp et al. | 101/420 |
| 5,009,160 | 4/1991 | Duarte | 101/422 |
| 5,046,421 | 9/1991 | DeMoore | 101/420 |
| 5,219,160 | 6/1993 | Kemp | 101/422 |

FOREIGN PATENT DOCUMENTS

| | | | |
|---|---|---|---|
| 0036937 | 10/1981 | European Pat. Off. | 101/420 |
| 0059944 | 9/1982 | European Pat. Off. | 101/420 |

OTHER PUBLICATIONS

"Heidelberg M-Offset 48×65cm-19×25½" Multicolour-Perfecto (U.S. Pat. No. 4,227,459) Operation Manuel, Oct. 1981.

*Primary Examiner*—Eugene H. Eickholt

*Attorney, Agent, or Firm*—Oltman and Flynn

[57] ABSTRACT

A printed sheet transfer assembly for supporting and carrying sheets from one station in a printer apparatus to another station includes a transfer structure including a sheet conveying surface, and a flexible resilient material secured tightly over the conveying surface and having several ridges for engaging and conveying the sheets and for cushioning the sheets to prevent marring of printing ink. The material may include an ultra-soft cotton fabric. The conveying surface includes a matte finish. The transfer structure is optionally a transfer cylinder. The material may be secured over the conveying surface with hook and loop fasteners. A method of preparing a printing press transfer structure having a sheet conveying surface for transferring printed sheets from one station of a printer apparatus to another station includes the steps of covering at least part of the conveying surface with yielding ridged material, and tightening the material over the conveying surface to a tension level sufficient to take up slack in the material but insufficient to pull out the ridges. The method may additionally include the step of creating a matt finish on the conveying surface to cause the conveying surface to more securely hold the material against motion relative to the conveying surface.

6 Claims, 1 Drawing Sheet

METHOD AND APPARATUS FOR HANDLING SHEET MATERIAL USING RIDGED NETTING

BACKGROUND OF THE INVENTION

1. Field of the Invention

The present invention relates generally to the field of devices for supporting and transferring printed sheets from one printing press station to another, and more specifically to a transfer structure such as a cylinder wrapped in a soft netting material such as ultra-soft cotton fabric which is embossed or ridged, which is fit snugly around the cylinder, but not so tightly as to pull the ridging out of the netting material, for supporting and transferring a freshly printed sheet, the ridges serving to engage the sheet much like teeth while cushioning and yielding as the freshly printed surface of the sheet bears against the ridges to prevent smearing or other marring of wet ink, the cylinder preferably including a conveying surface with a matte finish to minimize slipping of the netting material relative to the conveying surface. A method is also provided of covering a conveying surface of a transfer structure such as a cylinder with yielding ridged material, and tightening the material to a tension level just short of pulling out the ridges, then causing the transfer structure to move relative to a printing press station in such a way as to pick up the sheet and carry it to another such station.

2. Description of the Prior Art

There have long been transfer structures for supporting and conveying freshly printed sheets of material from one station of a printing press to the next station. A key design objective has been for the structure to sufficiently grip the sheet to move it without smearing or smudging the wet ink on its surface.

One such prior transfer structure is that of DeMoore, U.S. Pat. No. 4,402,267, issued on Sep. 6, 1983. DeMoore teaches a method and apparatus for handling printed sheet material, including a skeleton transfer cylinder. The cylinder is coated with a fluorocarbon composite material to provide a cushioning effect for the sheets. The cylinder is wrapped in a piece of fabric which is secured loosely for the intended purpose of preventing the transfer of wet ink from one sheet to a successive sheet. The fabric is treated with an absorbance retarding substance such as SCOTCHGARD TM. A problem with DeMoore is that this structure is not well suited to small printing presses. Another problem is that loose, flopping fabric can bunch and wear quickly. The flopping fabric has a tendency of slapping the tail end of the impression cylinder and creating an ink build-up on the tail end of the transfer cylinder, and the netting thereon, which will cause marring of the surface of the next sheet of paper that is transferred.

Ellis, U.S. Pat. No. 1,231,141, issued on Jun. 26, 1917, discloses a fabric for printers' blankets and other purposes. Ellis describes a multiple layer blanket for packing impression cylinders of newspaper presses. The outer layer face is felt covered. It appears unclear whether the blanket material is intended to fit tightly or loosely over an impression cylinder. A problem with Ellis is that felt can mar a freshly printed surface. Another problem is that the multiple layer construction would likely be costly.

Goldsmith, U.S. Pat. No. 944,607, issued on Dec. 28, 1909, teaches tile coating machinery. Goldsmith includes a coating roll having a ribbed rubber periphery enclosed within a foraminous metallic sleeve. The foraminous sleeve is loosely mounted on the roll. A problem with Goldsmith is that the metallic sleeve would likely damage printed sheets and mar wet ink on their surfaces.

Boucher, U.S. Pat. No. 1,152,596, issued on Sep. 7, 1915, reveals a covering for use on a suction-roll which is used on paper making machines. The covering consists of a coarse knit sleeve, preferably knit from wool worsted yarn and adapted to be stretched over the suction roll. A problem with Boucher is that the coarse sleeve would likely be too rigid to convey freshly inked sheets without marring. Another problem is that these sleeves might slip on a typical smooth surfaced transfer cylinder.

Dickerson, U.S. Pat. No. 3,261,288, issued on Jul. 19, 1966, discloses an anti-smear jacket for a printing press transfer drum. Dickerson uses a series of elongated resilient spacing elements or strips on the outside of a transfer cylinder instead of fabric. A problem with Dickerson is that the hard, resilient strips could mar wet ink on a sheet.

McGibbon, U.S. Pat. No. 4,023,967, issued on May 17, 1977, reveals an electrophotographic liquid development method in which a uniform substantial interface contact is maintained. McGibbon uses a roller device having a core loosely circumscribed axially with a flexible sleeve, with a space between the core and the sleeve being substantially uniform. This space is filled with a curable plastic foam material to obtain a uniform contact and nip width when in rotational contact with cooperating surface. A problem with McGibbon is that the loose mounting of the sleeve on the core promotes marring and rapid sleeve wear. Another problem is that the resilient full sleeve contact can also increase the likelihood of marring.

An operation manual, entitled "Heidelberg M-Offset Multicolour-Perfector", dated October 1981, discloses a loosely mounted glass-bead blanket mounted on a transfer cylinder. A wire gauze material is used instead of a fabric. The problems presented by Heidelberg are essentially those of Dickerson.

Hartmann, U.S. Pat. No. 1,255,603, filed Feb. 3, 1916, discloses a printing cloth for presses where the cloth is tensioned around a printing roller or cylinder to convey printed stock. The outer conveying surface of the cylinder is grooved. A problem with Hartmann is that the cloth itself is not stated to be ridged or grooved to engage and convey the printed stock, which makes smearing and other marring likely.

It is thus an object of the present invention to provide a method and apparatus for transferring and supporting freshly printed sheets between printing press stations without marring the wet ink.

It is another object of the present invention to provide such a method and apparatus which is well suited for use on many of the smaller printing presses.

It is still another object of the present invention to provide such a method and apparatus which operate with minimal wear and maximum longevity.

It is finally an object of the present invention to provide such a method and apparatus which are reliable and produce a printed sheet product of consistent high quality.

SUMMARY OF THE INVENTION

The present invention accomplishes the above-stated objectives, as well as others, as may be determined by a fair reading and interpretation of the entire specification.

A printed sheet transfer assembly is provided for supporting and carrying sheets from one station in a printer apparatus to another station, including a transfer structure including a sheet conveying surface, and a flexible resilient material secured tightly over the conveying surface and having several ridges for engaging and conveying the sheets and for cushioning the sheets to prevent marring of printing ink. The material may include an ultra-soft cotton fabric. The conveying surface includes a matte finish. The transfer structure is optionally a transfer cylinder. The material may be secured over the conveying surface with hook and loop fasteners. A method is also provided of preparing a printing press transfer structure having a sheet conveying surface for transferring printed sheets from one station of a printer apparatus to another station, including the steps of covering at least part of the conveying surface with yielding ridged material, and tightening the material over the conveying surface to a tension level sufficient to take up slack in the material but insufficient to pull out the ridges. The method may additionally include the step of creating a matt finish on the conveying surface to cause the conveying surface to more securely hold the material against motion relative to the conveying surface.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
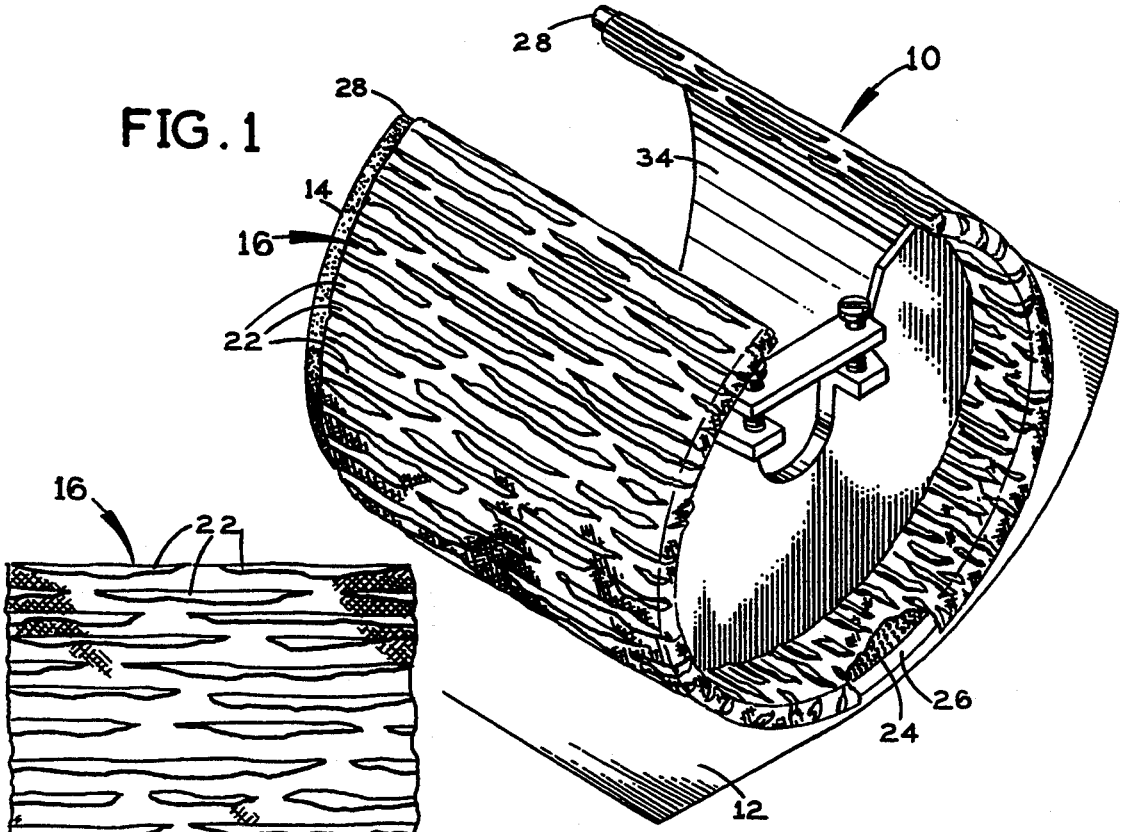
FIG. 1 is a partial perspective view of a transfer cylinder inventively equipped with the tightly secured ridged cover material.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
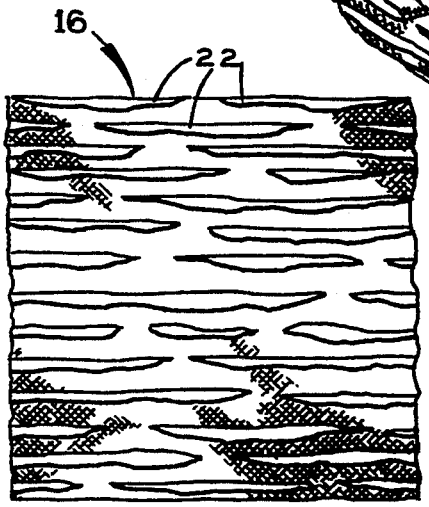
FIG. 2 is a close-up view of the preferred ridged cover material.
Figure 3:
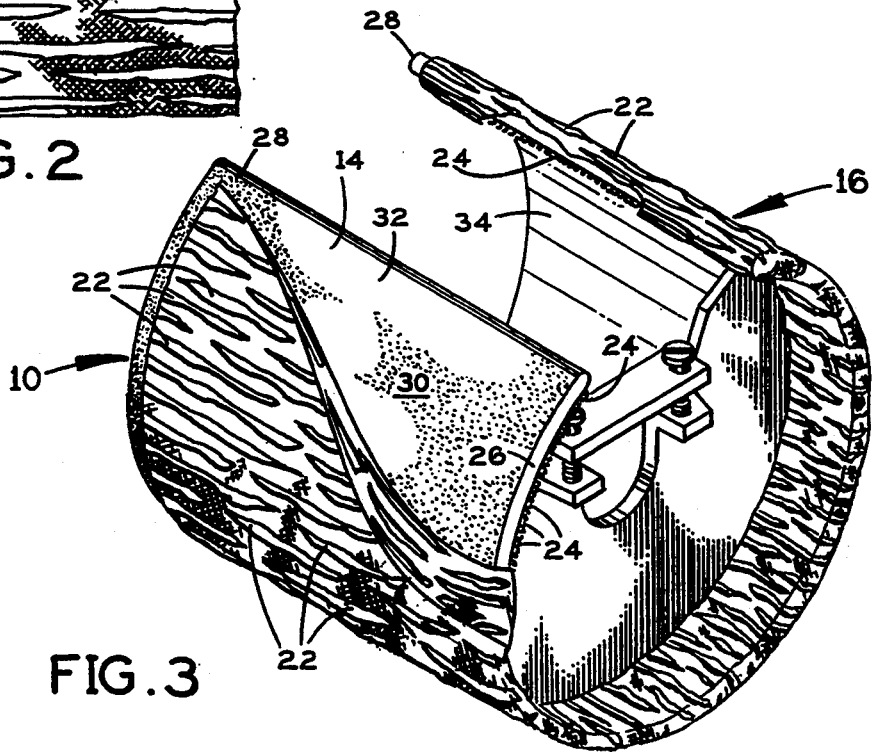
FIG. 3 is a view as in FIG. 1, with the ridged material pulled back to reveal the matte finish on the transfer cylinder conveying surface and some of the hook and loop fasteners.

Referring to FIGS. 1, 2 and 3, a printed sheet transferring assembly 10 is disclosed for supporting and conveying printed sheets 12 from one printing press station to another. Assembly 10 for purposes of illustration includes a conventional transfer cylinder 14, but cylinder 14 may equivalently be a drum, wheel, shell or other suitable transfer structure. Cylinder 14 is wrapped in a soft netting material 16 which is embossed or ridged. See FIG. 1. This material 16 may be an ultra-soft cotton fabric, and is also known in the printing industry as ridged netting or krinkle gauze. See FIG. 2.

Material 16 is fit tightly around cylinder 14, but not so tightly as to pull the wrinkles or ridges 22 out of the material 16. Ridges 22 serve to engage the printed sheets 12 much like teeth while cushioning and yielding as each freshly printed sheet 12 bears against ridges 22 to prevent smearing or other marring of printed wet ink. Ridges 22 collapse and then resiliently return to substantially their original shape after a sheet 12 has been conveyed off of cylinder 14. Material 16 is preferably secured with hook and loop fasteners 24 such as VELCRO TM within cylinder 14 end rims 26. Material 16 may additionally be secured along the longitudinal edges 28 or the inner surfaces 34 of cylinder 14. Fibers of material 16 may themselves engage or be engaged by fasteners 14. See FIGS. 1 and 3.

Cylinder 14 preferably includes a rough finish 30 on its outer surface 32 to minimize slipping of material 16 relative to cylinder 14, to further minimize marring of wet ink. Finish 26 is preferably a tumbled or sandblasted matte finish. See FIG. 3. The matte finish 30 effectively produces a tooth to engage the fibers of material 16 to keep slippage of material 16 to a minimum while allowing the ridges 22 to collapse under the pressure of the sheet 12.

Method

In practicing the invention, the following method may be used. A conveying or carrying surface 32 of a transfer structure such as a cylinder 14 is covered with a yielding ridged material 16. The material 16 is tightened over surface 32 to a tension magnitude sufficient to take up slack in material 16 but insufficient to pulling out ridges 22. Then transfer cylinder 14 is made to move relative to a freshly printed sheet 12 at a printing press station in such a way as to pick up sheet 12 and carry it to another printing press station.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A printed sheet transfer assembly for supporting and carrying printed sheets from one station in a printer apparatus to another said station, comprising:
   - a transfer structure comprising a printed sheet conveying surface,
   - said conveying surface comprising a matte finish,
   - a flexible resilient conveying sheet secured tightly over said conveying surface anti having a plurality of undulations for engaging and conveying said printed sheets and for cushioning said printed sheets to prevent marring of printing ink.

2. An apparatus according to claim 1, wherein said conveying sheet comprises an ultra-soft cotton fabric.

3. An apparatus according to claim 1, wherein said transfer structure is a transfer cylinder.

4. An apparatus according to claim 1, wherein said conveying sheet is secured over said conveying surface with hook and loop fastener means.

5. A method of preparing a printing press transfer structure having a printed sheet conveying surface for transferring printed sheets from one station of a printer apparatus to another station, comprising the steps of:

covering at least part of said conveying surface with a yielding conveying sheet having sheet undulations, tightening said conveying sheet over said conveying surface to a tension level sufficient to take up slack in said conveying sheet but insufficient to pull out said undulations, creating a matte finish on said conveying surface to cause said conveying surface to more securely hold said conveying sheet against motion relative to said conveying surface.

6. A printed sheet transfer assembly for supporting and carrying printed sheets from one station in a printer apparatus to another said station, comprising:

a transfer structure comprising a printed sheet conveying surface, a flexible resilient conveying sheet secured tightly over said conveying surface and having a plurality of undulations for engaging and conveying said printed sheets and for cushioning said printed sheets to prevent marring of printing ink, said undulations comprising embossments.

* * * * *